US011542636B2

(12) United States Patent
Bowles et al.

(10) Patent No.: US 11,542,636 B2
(45) Date of Patent: Jan. 3, 2023

(54) COMPOSITE TEXTILE STRUCTURE FOR SENSING, ACTIVATION, AND SIGNAL NETWORK

(71) Applicant: Flex Ltd., Singapore (SG)

(72) Inventors: Allison E. Bowles, Boston, MA (US); Brendan Joseph Nagle, Pleasanton, CA (US); Anthony Joseph Piazza, San Jose, CA (US); Biren Salunke, Milpitas, CA (US); Adam M. Whiton, Chestnut Hill, MA (US)

(73) Assignee: Flex Ltd., Singapore (SG)

( * ) Notice: Subject to any disclaimer, the term of this patent is extended or adjusted under 35 U.S.C. 154(b) by 65 days.

(21) Appl. No.: 17/039,227

(22) Filed: Sep. 30, 2020

(65) Prior Publication Data

US 2021/0095401 A1 Apr. 1, 2021

Related U.S. Application Data

(60) Provisional application No. 62/908,090, filed on Sep. 30, 2019.

(51) Int. Cl.
*D02G 3/44* (2006.01)
*D02G 3/34* (2006.01)
(Continued)

(52) U.S. Cl.
CPC ..... *D02G 3/441* (2013.01); *A41D 1/005* (2013.01); *D02G 3/34* (2013.01); *D04B 1/12* (2013.01);
(Continued)

(58) Field of Classification Search
None
See application file for complete search history.

(56) References Cited

U.S. PATENT DOCUMENTS

2009/0159149 A1 6/2009 Karayianni et al.
2009/0234265 A1 9/2009 Reid, Jr. et al.
(Continued)

FOREIGN PATENT DOCUMENTS

DE 102008036250 2/2010
WO WO 2018/204688 11/2018

OTHER PUBLICATIONS

International Search Report and Written Opinion for International (PCT) Patent Application No. PCT/2020/063833, dated Jan. 21, 2021 21 pages.
(Continued)

*Primary Examiner* — Shawn Mckinnon
(74) *Attorney, Agent, or Firm* — Sheridan Ross P.C.

(57) ABSTRACT

Embodiments of the disclosure provide structures for sensing, activation, and signal networking in a composite textile. According to one embodiment, a composite textile can comprise an activation layer of a reactive yarn knit into a fabric. The reactive yarn can have at least one physical property that changes in response to a stimulus. A signaling layer of a first conductive yarn can be knit into the fabric with the activation layer. The first conductive yarn provides the stimulus to the reactive yarn. A sensing layer comprising second conductive yarn can be knit into the fabric with the activation layer and signaling layer. The second conductive yarn can provide a feedback signal corresponding to the stimulus provided by the first conductive yarn of the signaling layer.

20 Claims, 5 Drawing Sheets

(51) Int. Cl.

| | |
|---|---|
| ***A41D 1/00*** | (2018.01) |
| ***D04B 1/12*** | (2006.01) |
| ***D04B 1/24*** | (2006.01) |

(52) U.S. Cl.

CPC ..... *D04B 1/123* (2013.01); *D04B 1/24* (2013.01); *D10B 2401/04* (2013.01); *D10B 2401/046* (2013.01); *D10B 2401/16* (2013.01); *D10B 2401/18* (2013.01); *D10B 2401/20* (2013.01); *D10B 2501/00* (2013.01); *Y10T 442/674* (2015.04)

(56) References Cited

U.S. PATENT DOCUMENTS

| | | | | |
|---|---|---|---|---|
| 2017/0035605 | A1 | 2/2017 | Estreicher et al. | |
| 2018/0279930 | A1* | 10/2018 | Coppedè ..... | D04B 1/16 |

OTHER PUBLICATIONS

International Search Report and Written Opinion for International (PCT) Patent Application No. PCT/IB2020/000818, dated Jan. 21, 2021 21 pages.

International Preliminary Report on Patentability for International (PCT) Patent Application No. PCT/IB2020/000818, dated Apr. 14, 2022 10 pages.

* cited by examiner

COMPOSITE TEXTILE STRUCTURE FOR SENSING, ACTIVATION, AND SIGNAL NETWORK

CROSS REFERENCE TO RELATED APPLICATION

The present application claims the benefits of and priority, under 35 U.S.C. § 119(e), to U.S. Provisional Application No. 62/908,090 filed Sep. 30, 2019 by Piazza et al and entitled "Knit Composite Structure for Sensing, Activation, and Signal network" of which the entire disclosure is incorporated herein by reference for all purposes.

FIELD OF THE DISCLOSURE

Embodiments of the present disclosure relate generally to textiles, and more specifically to structures for sensing, activation, and signal networking in a composite textile.

BRIEF SUMMARY

Embodiments of the disclosure provide structures for sensing, activation, and signal networking in a composite textile. According to one embodiment, a composite textile can comprise an activation layer of a reactive yarn knit into a fabric. The reactive yarn can have at least one physical property that changes in response to a stimulus. A signaling layer of a first conductive yarn can be knit into the fabric with the activation layer. The first conductive yarn provides the stimulus to the reactive yarn. A sensing layer comprising second conductive yarn can be knit into the fabric with the activation layer and signaling layer. The second conductive yarn can provide a feedback signal corresponding to the stimulus provided by the first conductive yarn of the signaling layer.

For example, the activation layer and signaling layer can be knit in an interconnecting Jacquard pattern. The sensing layer, for example, can be knit into the activation layer and signaling layer as an inlay. In some cases, the stimulus can be heat and the first conductive yarn can comprise a heating element for the reactive yarn. Additionally, or alternatively, the stimulus can be light and the first conductive yarn can comprise a fiber optic element providing light to the reactive yarn. The second conductive yarn can comprise, in some cases, a temperature sensor. The reactive yarn can comprise a thermochromic yarn, a pharmaceutical delivery yarn, or other yarn material that reacts to heat, light, electrical input, etc.

According to another embodiment, a garment can comprise a fabric forming at least a portion of the garment. The fabric can comprise an activation layer of a reactive yarn knit into the fabric. The reactive yarn can have at least one physical property that changes in response to a stimulus. A signaling layer of a first conductive yarn can be knit into the fabric with the activation layer. The first conductive yarn provides the stimulus to the reactive yarn. A sensing layer comprising second conductive yarn can be knit into the fabric with the activation layer and signaling layer. The second conductive yarn can provide a feedback signal corresponding to the stimulus provided by the first conductive yarn of the signaling layer.

The activation layer and signaling layer of the fabric of the garment can be knit in an interconnecting Jacquard pattern, for example. The sensing layer, for example, can be knit into the activation layer and signaling layer as an inlay. In some cases, the stimulus can be heat and the first conductive yarn can comprise a heating element for the reactive yarn. Additionally, or alternatively, the stimulus can be light and the first conductive yarn can comprise a fiber optic element providing light to the reactive yarn. The second conductive yarn can comprise, in some cases, a temperature sensor. The reactive yarn can comprise a thermochromic yarn, a pharmaceutical delivery yarn, or other yarn material that reacts to heat, light, electrical input, etc.

According to another embodiment, a wearable device can comprise a fabric forming at least a portion of the wearable device. The fabric can comprise an activation layer of a reactive yarn knit into the fabric. The reactive yarn can have at least one physical property that changes in response to a stimulus. A signaling layer of a first conductive yarn can be knit into the fabric with the activation layer. The first conductive yarn provides the stimulus to the reactive yarn. A sensing layer comprising second conductive yarn can be knit into the fabric with the activation layer and signaling layer. The second conductive yarn can provide a feedback signal corresponding to the stimulus provided by the first conductive yarn of the signaling layer.

The activation layer and signaling layer of the fabric of the wearable device can be knit in an interconnecting Jacquard pattern, for example. The sensing layer, for example, can be knit into the activation layer and signaling layer as an inlay. In some cases, the stimulus can be heat and the first conductive yarn can comprise a heating element for the reactive yarn. Additionally, or alternatively, the stimulus can be light and the first conductive yarn can comprise a fiber optic element providing light to the reactive yarn. The second conductive yarn can comprise, in some cases, a temperature sensor. The reactive yarn can comprise a thermochromic yarn, a pharmaceutical delivery yarn, or other yarn material that reacts to heat, light, electrical input, etc.

Figure 1:
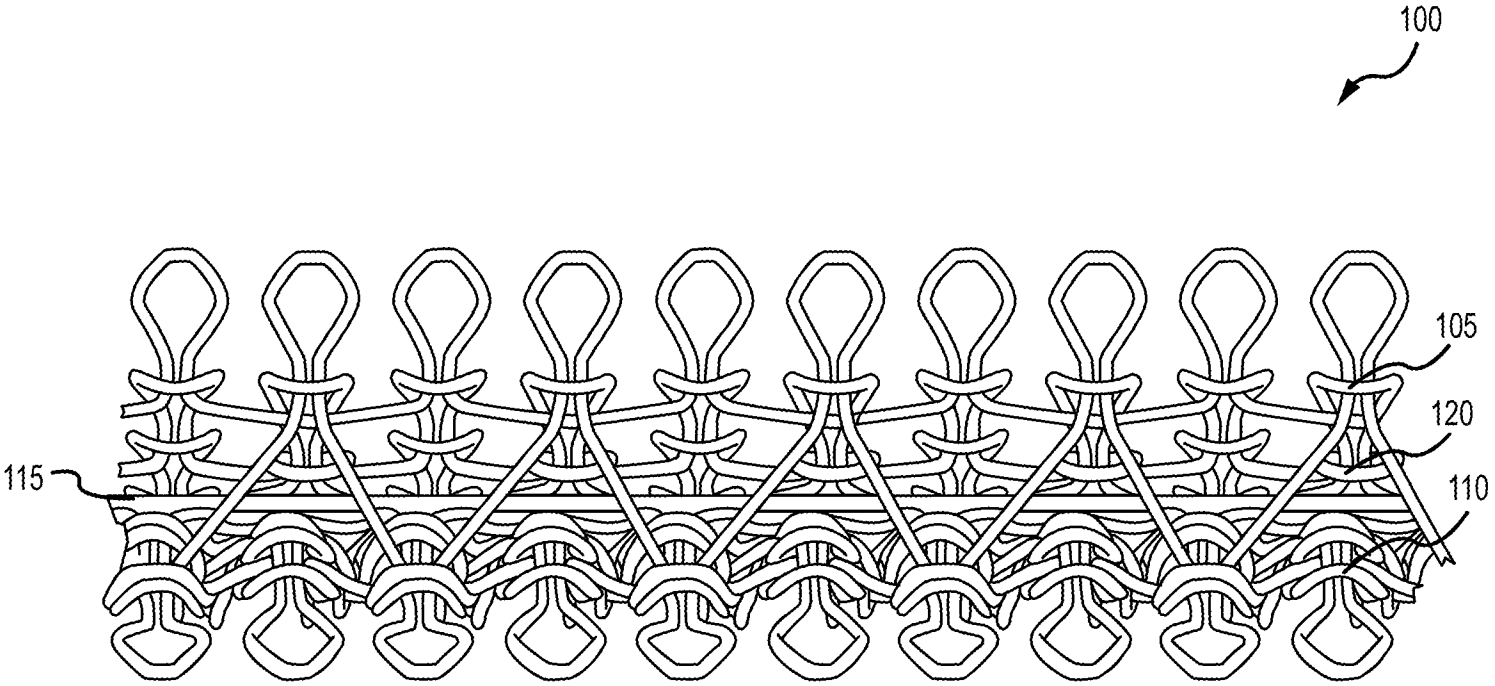
FIG. 1 is diagram illustrating an expanded view of a composite according to embodiments of the present disclosure.

In the appended figures, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label.

DETAILED DESCRIPTION

In the following description, for the purposes of explanation, numerous specific details are set forth in order to provide a thorough understanding of various embodiments disclosed herein. It will be apparent, however, to one skilled in the art that various embodiments of the present disclosure may be practiced without some of these specific details. The ensuing description provides exemplary embodiments only and is not intended to limit the scope or applicability of the disclosure. Furthermore, to avoid unnecessarily obscuring the present disclosure, the preceding description omits a number of known structures and devices. This omission is not to be construed as a limitation of the scopes of the claims. Rather, the ensuing description of the exemplary embodiments will provide those skilled in the art with an enabling description for implementing an exemplary embodiment. It should however be appreciated that the present disclosure may be practiced in a variety of ways beyond the specific detail set forth herein.

As used herein, the phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the disclosure, brief description of the drawings, detailed description, abstract, and claims themselves.

Various additional details of embodiments of the present disclosure will be described below with reference to the figures. While the flowcharts will be discussed and illustrated in relation to a particular sequence of events, it should be appreciated that changes, additions, and omissions to this sequence can occur without materially affecting the operation of the disclosed embodiments, configuration, and aspects.

Embodiments described herein include a composite structure with electrically conductive yarn knit in a Jacquard pattern and comprising signal yarn, activation yarn, and sensing yarn in a composite fabric structure that can be exposed on either the interior or exterior of a tubular inlay structure for a variety of applications based on how yarns interact with each other and ambient conditions. The composite can also comprise a conductive sensing yarn inlayed into the fabric for feedback control.

For example, the signal yarn can act as heating element and the activation yarn can comprise a dyed thermochromic yarn knit as tubular face that can change appearance based on electrical activation of the conductive signal yarn. These composites can comprise a control arrangement in X, Y, and Z-directions of the fabric for different combinations of signal, activation, and sensing capabilities by arrangement of front loops and back loops throughout fabric. The signal yarn, activation yarn, and sensing yarn can be patterned all together or separated into different areas of fabric in order to manipulate the properties and performance of fabric by strategically mixing materials.

Since the fabric is knitted from yarn, the composite can maintain conformability and breathability of a textile. The composite can be knit on commonly available industrial machinery such as flatbed knitting machines and can be formed into three-dimensional shapes via machine knitting. A composite according to embodiments described herein can be used in a wide variety of applications including but not limited to: color changing fabrics, biosensing fabrics, drug delivery fabrics, compression control, ventilation control, texture transformation, physical therapy, and others.

FIG. 1 is diagram illustrating an expanded view of a composite according to embodiments of the present disclosure. According to one embodiment and as illustrated here, a composite textile can comprise one or more activation layers 105 of a reactive yarn knit into a fabric 100. The reactive yarn can have at least one physical property that changes in response to a stimulus. For example, the reactive yarn can comprise a thermochromic yarn that changes color in a certain temperature range, a pharmaceutical delivery yarn impregnated or coated with a drug that is released from the yarn to be absorbed through the skin of a wearer of a device made of the fabric 100 and/or which is activated within a certain temperature range or in response to the presence of UltraViolet (UV) light or other light, for example, other yarn material that reacts to heat, light, electrical input, etc. by changing some physical property or characteristic including, but not limited to, texture, stiffness/pliability, elasticity, etc. A combination of activation layers 105 and 110 can be used, depending upon the implementation, to provide for various changes. For example, one activation layer 105 may comprise a pharmaceutical releasing yarn that responds to temperature and another activation layer 110 can comprise a thermochromic yarn that responds to a corresponding temperature to change colors and thereby indicate release of the drug. Other combinations are contemplated and considered to be within the scope of the present disclosure.

A signaling layer 115 of a first conductive yarn can be knit into the fabric 100 with the activation layer(s) 105 and 110. As used herein, the term conductive means not just electrically conductive but is intended to mean having the ability to conduct some form of energy, e.g., electricity, light, heat, etc. Suh yarns are commonly available and known in the art. The first conductive yarn can provide the stimulus to the reactive yarn of the activation layer(s) 105 and 110. For example, the stimulus can be heat and the first conductive yarn can comprise a heating element for the reactive yarn. Additionally, or alternatively, the stimulus can be light, e.g., UV, InfraRed (IR), visible light, etc., and the first conductive yarn can comprise a fiber optic element providing light to the reactive yarn.

A sensing layer 120 comprising second conductive yarn can be knit into the fabric 100 with the activation layer(s) 105 and 110 and signaling layer 115. The second conductive yarn can provide a feedback signal corresponding to the stimulus provided by the first conductive yarn of the signaling layer. For example, the activation layer(s) 105 and 110 and signaling layer 115 can be knit in an interconnecting Jacquard pattern. The sensing layer 120, for example, can be knit into the activation layer(s) 105 and 110 and signaling layer 115 as an inlay. In some cases second conductive yarn can comprise, for example, a temperature sensor. It should be understood that a Jacquard pattern is one possible pattern. In other implementations, different patterns may be used without departing from the scope of the present disclosure. With the knitting and weaving processes, the positioning of the yarns in relation to each other can be accurately controlled. In some cases, the yarns of the activation layer may need to be in direct physical contact with the yarns of the signaling layer. In other cases, they may need to be within a specific distance or with a specific orientation. The knitting and weaving process allow control of the placement but some signal, activation and sensing layers as needed.

Figure 2A:
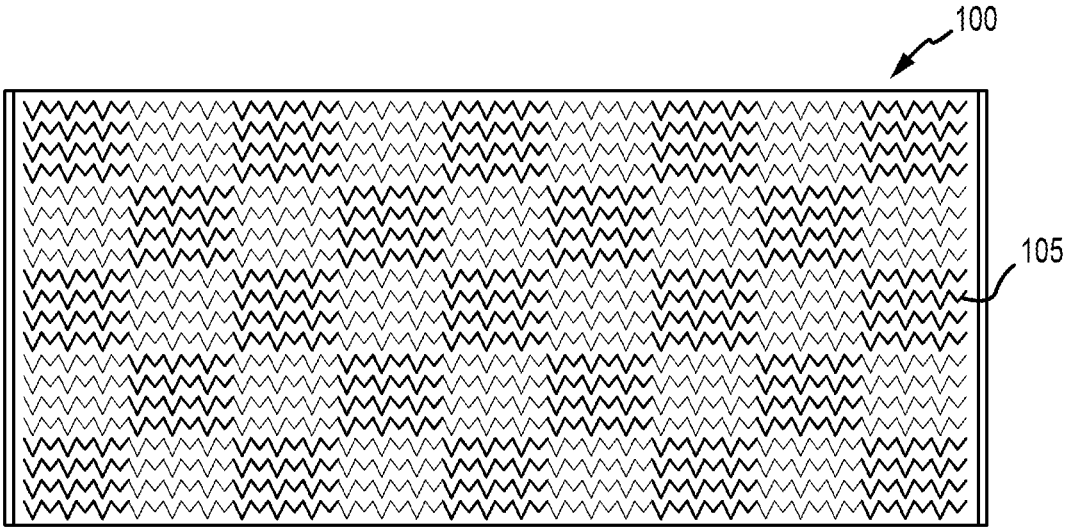
FIGS. 2A and 2B are diagrams illustrating thermochromic activation of a composite according to one embodiment of the present disclosure.
Figure 2B:
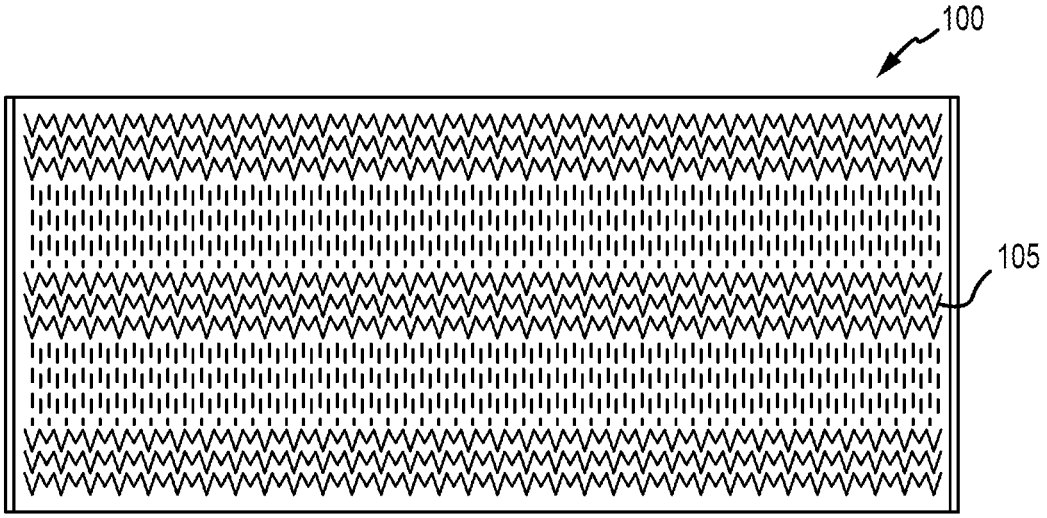

FIGS. 2A and 2B are diagrams illustrating thermochromic activation of a composite according to one embodiment of the present disclosure. More specifically, this example illustrates an example of the fabric 100 described above having at least one activation layer 105 knit of a thermochromic yarn. FIG. 2A illustrates the fabric 100 in a first state. Here, that first state is a plaid pattern appearance. FIG. 2B illustrates the fabric 100 in a second state having a different appearance caused by a color in yarn of the activation layer 105 having changed color due to the application of heat through the signaling layer 115 (not shown here) as described above.

Figure 3:
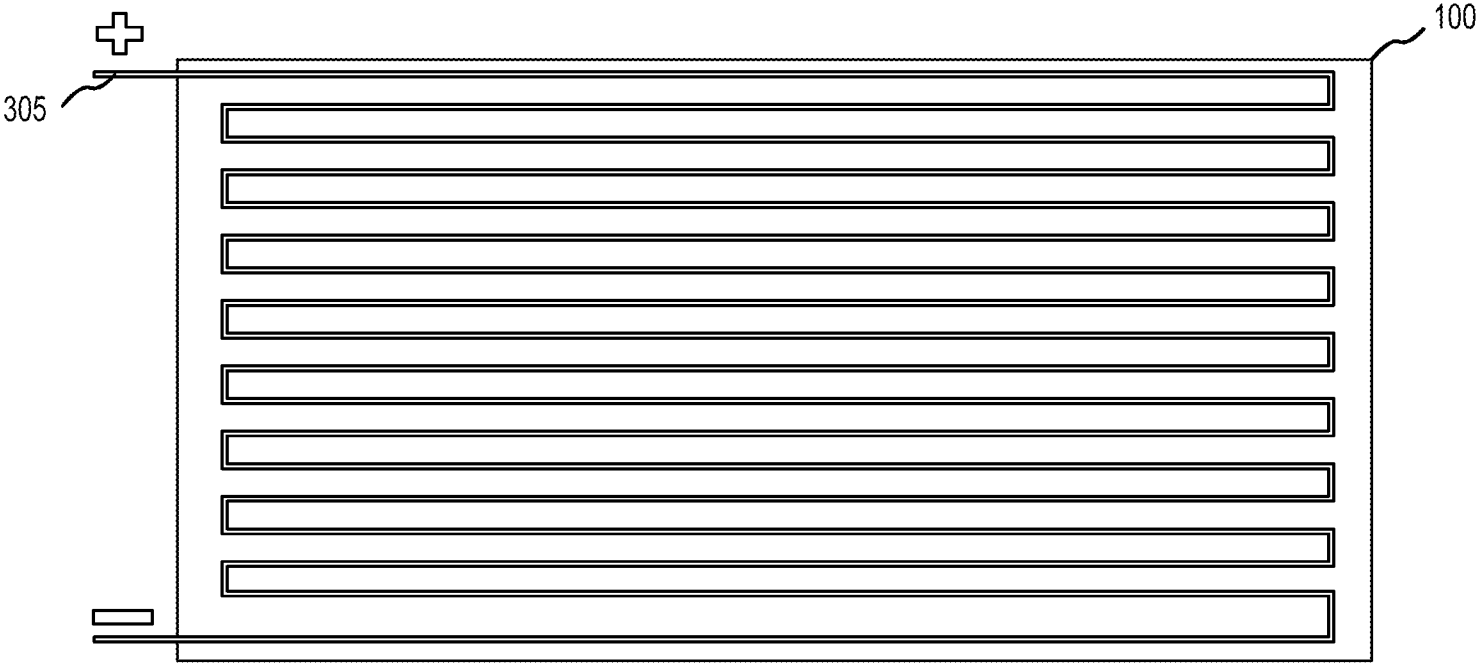
FIG. 3 is a diagram illustrating an exemplary layout of a first conductive yarn in a signaling layer of a composite according to one embodiment of the present disclosure.
Figure 4A:
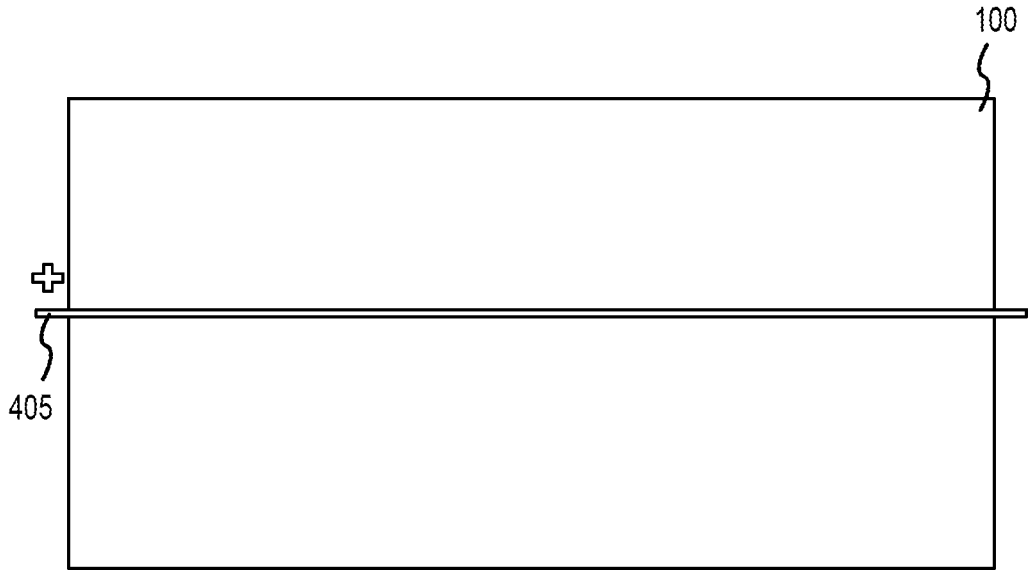
FIGS. 4A-4D are diagrams illustrating various exemplary layouts of a second conductive yarn in a sensing layer of a composite according to one embodiment of the present disclosure.
Figure 4B:
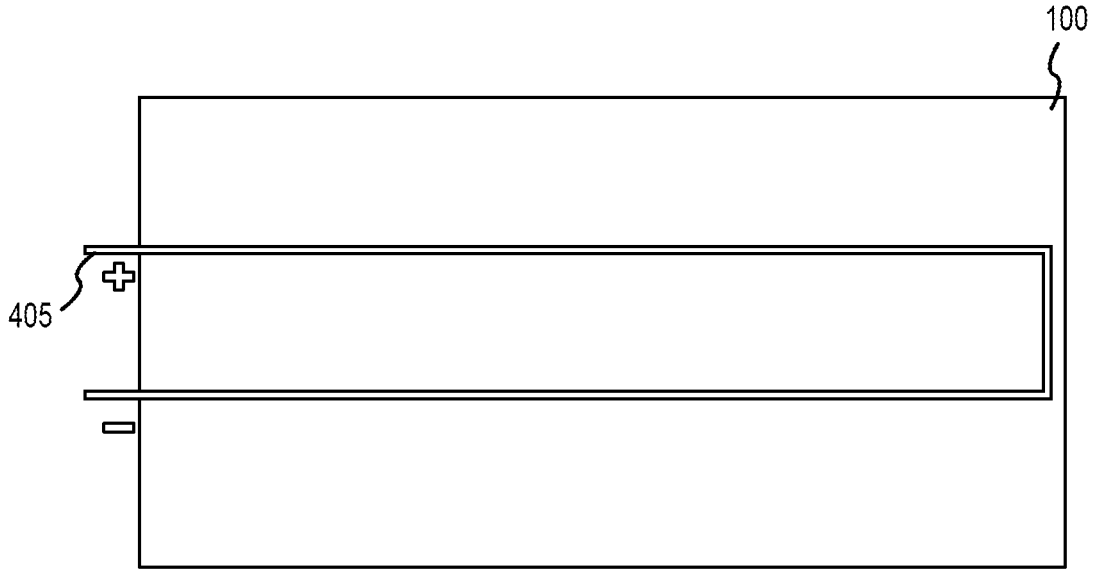
Figure 4C:
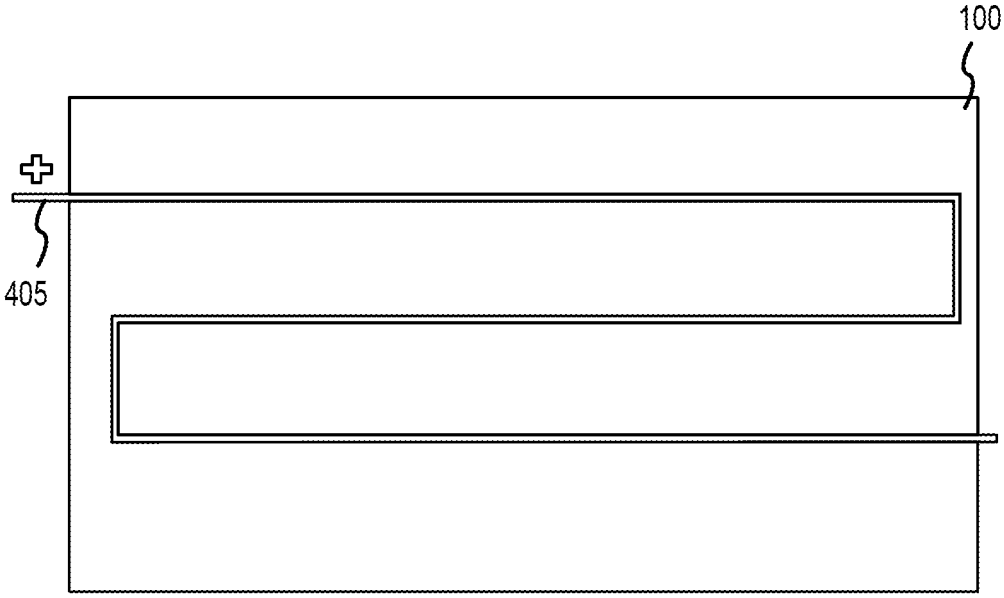
Figure 4D:
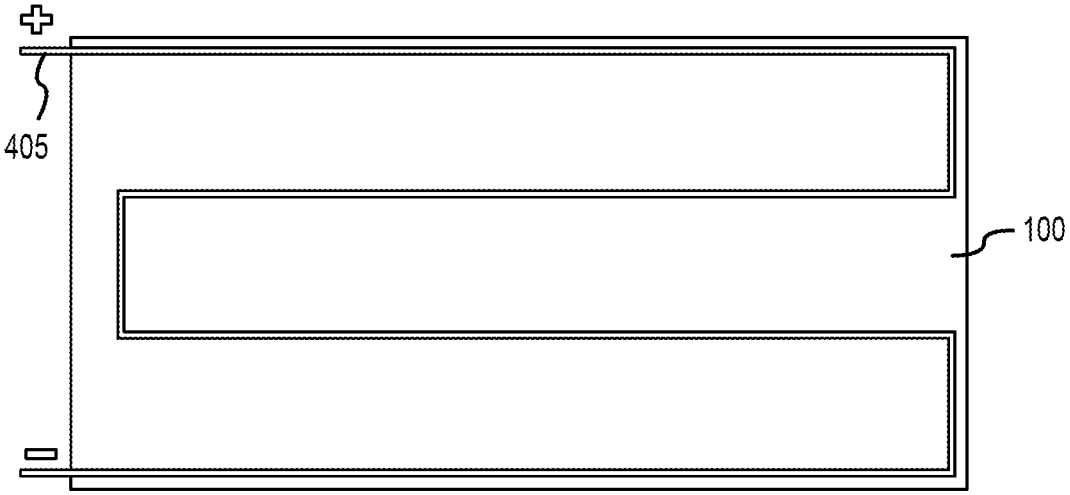

FIG. 3 is a diagram illustrating an exemplary layout of a first conductive yarn in a signaling layer of a composite according to one embodiment of the present disclosure. More specifically, this example illustrates the fabric 100 with one possible layout of the first conductive yarn 305 in the fabric 100. As mentioned above, the first conductive yarn 305 can comprise a resistive conductor providing heating to the activation layer(s) of the fabric 100. It should be noted and understood that this layout is offered by way of example only and is not intended to limit the scope of the present disclosure. Rather, the pattern may vary widely depending upon the implementation and location and types of stimulus needed by the activation layers. All such variations are considered to be within the scope of the present disclosure.

FIGS. 4A-4D are diagrams illustrating various exemplary layouts of a second conductive yarn in a sensing layer of a composite according to one embodiment of the present disclosure. More specifically, this example illustrates a variety of patterns for the second conductive yarn 405 of the sensing layer inlaid in the fabric 100. It should be noted and understood that these patterns are offered by way of example only and are not intended to limit the scope of the present disclosure. Rather, and as introduced here, the patterns may vary widely depending upon the implementation and location and types of stimulus provided by the signaling layer to be detected. All such variations are considered to be within the scope of the present disclosure.

The present disclosure, in various aspects, embodiments, and/or configurations, includes components, methods, processes, systems, and/or apparatus substantially as depicted and described herein, including various aspects, embodiments, configurations embodiments, sub-combinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and\or reducing cost of implementation.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A composite textile comprising:

an activation layer of a reactive yarn knit into a fabric, the reactive yarn having at least one physical property that changes in response to a stimulus, wherein the stimulus comprises one of heat or light;

a signaling layer of a first conductive yarn knit into the fabric with the activation layer, wherein the first conductive yarn provides the stimulus to the reactive yarn; and a sensing layer comprising second conductive yarn knit into the fabric with the activation layer and signaling layer, the second conductive yarn providing a feedback signal corresponding to the stimulus provided by the first conductive yarn of the signaling layer.

2. The composite textile of claim 1, wherein the activation layer and signaling layer are knit in an interconnecting Jacquard pattern.

3. The composite textile of claim 2, wherein the sensing layer is knit into the activation layer and signaling layer as an inlay.

4. The composite textile of claim 1, wherein the stimulus is heat and wherein the first conductive yarn comprises a heating element for the reactive yarn.

5. The composite textile of claim 1, wherein the stimulus is light and the first conductive yarn comprises a fiber optic element providing light to the reactive yarn.

6. The composite textile of claim 1, wherein the second conductive yarn comprises a temperature sensor.

7. The composite textile of claim 1, wherein the reactive yarn comprises a thermochromic yarn.

8. The composite textile of claim 1, wherein the reactive yarn comprises a pharmaceutical delivery yarn.

9. A garment comprising:

a fabric forming at least a portion of the garment, the fabric comprising:

an activation layer of a reactive yarn knit into the fabric, the reactive yarn having at least one physical property that changes in response to a stimulus, wherein the stimulus comprises one of heat or light;

a signaling layer of a first conductive yarn knit into the fabric with the activation layer, wherein the first conductive yarn provides the stimulus to the reactive yarn; and a sensing layer comprising second conductive yarn knit into the fabric with the activation layer and signaling layer, the second conductive yarn providing a feedback signal corresponding to the stimulus provided by the first conductive yarn of the signaling layer.

10. The garment of claim 9, wherein the activation layer and signaling layer are knit in an interconnecting Jacquard pattern and wherein the sensing layer is knit into the activation layer and signaling layer as an inlay.

11. The garment of claim 9, wherein the stimulus is heat and wherein the first conductive yarn comprises a heating element for the reactive yarn.

12. The garment of claim 9, wherein the stimulus is light and the first conductive yarn comprises a fiber optic element providing light to the reactive yarn.

13. The garment of claim 9, wherein the second conductive yarn comprises a temperature sensor.

14. The garment of claim 9, wherein the reactive yarn comprises a thermochromic yarn or a pharmaceutical delivery yarn.

15. A wearable device comprising:

a fabric forming at least a portion of the wearable device, the fabric comprising:

an activation layer of a reactive yarn knit into the fabric, the reactive yarn having at least one physical property that changes in response to a stimulus, wherein the stimulus comprises one of heat or light;

a signaling layer of a first conductive yarn knit into the fabric with the activation layer, wherein the first conductive yarn provides the stimulus to the reactive yarn; and a sensing layer comprising second conductive yarn knit into the fabric with the activation layer and signaling layer, the second conductive yarn providing a feedback signal corresponding to the stimulus provided by the first conductive yarn of the signaling layer.

16. The wearable device of claim 15, wherein the activation layer and signaling layer are knit in an interconnecting Jacquard pattern and wherein the sensing layer is knit into the activation layer and signaling layer as an inlay.

17. The wearable device of claim 15, wherein the stimulus is heat and wherein the first conductive yarn comprises a heating element for the reactive yarn.

18. The wearable device of claim 15, wherein the stimulus is light and the first conductive yarn comprises a fiber optic element providing light to the reactive yarn.

19. The wearable device of claim 15, wherein the second conductive yarn comprises a temperature sensor.

20. The wearable device of claim 15, wherein the reactive yarn comprises a thermochromic yarn or a pharmaceutical delivery yarn.

* * * * *